United States Patent [19]

Villar

[11] Patent Number: 5,058,293

[45] Date of Patent: Oct. 22, 1991

[54] FOOTWEAR WITH ANIMATED FACE

[75] Inventor: Anthony F. Villar, Westbury, N.Y.

[73] Assignees: Felix Benitez; Shirley Benitez, both of Altamonte Springs, Fla. ; part interest to each

[21] Appl. No.: 594,560

[22] Filed: Oct. 9, 1990

[51] Int. Cl.[5] ..... A43B 3/00; A43B 9/00

[52] U.S. Cl. ..... 36/136; 36/1

[58] Field of Search ..... 36/1, 136, 137, 139, 36/77 R; 446/26, 27, 372, 343, 369

[56] References Cited

U.S. PATENT DOCUMENTS

| | | | |
|---|---|---|---|
| D. 49,212 | 6/1916 | Hincks . | |
| 1,823,634 | 9/1931 | Wiesner | 36/102 |
| 2,274,694 | 3/1942 | Henry | 446/343 |
| 2,421,796 | 6/1947 | Maling . | |
| 2,572,760 | 10/1951 | Rikelman | 36/1 |
| 2,598,218 | 5/1952 | Brumby . | |
| 3,023,420 | 3/1962 | Tann . | |
| 3,070,907 | 1/1963 | Rocco . | |
| 3,226,849 | 1/1966 | Rosen . | |
| 3,473,198 | 10/1969 | Meier | 36/1 |
| 3,738,024 | 6/1973 | Matsuda | 36/2.5 R |
| 4,324,054 | 4/1982 | Rovinsky | 36/137 |
| 4,463,412 | 7/1984 | Broach | 36/137 |
| 4,845,865 | 6/1989 | Chang et al. | 36/136 |

FOREIGN PATENT DOCUMENTS

| | | | |
|---|---|---|---|
| 510447 | 8/1955 | Italy | 446/343 |

*Primary Examiner*—Paul T. Sewell
*Assistant Examiner*—Marie D. Patterson
*Attorney, Agent, or Firm*—Julian C. Renfro

[57] ABSTRACT

Novel footwear upon the upper front portion of which an animated face with movable eyes is located. The footwear comprises an inner sole, an outer sole, and an upper shoe surface affixed together in a wearable relationship, with an arch-shaped support member located in a forward interior portion of the footwear. The upper portion of the arch is in contact with the interior of the upper shoe surface, and its opposite lower edges are affixed to edge portions of the outer sole. The inner sole is interrupted at a forward location generally corresponding to the location of the arch, and an upwardly biased treadle member is operatively disposed at such interrupted location. Upon the forward part of the foot of the user, on occasion, entering such arch member and extending therethrough, the ball of the foot normally rests on the treadle. The upper central portion of the arch serves as support for simulated eye members that are displayed on the exterior of the upper shoe surface, which eye members are pivotally mounted in spaced apart locations on the arch member, and have normal as well as deflected positions. Linkage means interconnect the eye members and the treadle, such that the eye members are rotated each time the foot of the user presses down on the treadle member. The eyes are biased to rotate back to their normal positions when the user's weight is removed from the treadle.

25 Claims, 3 Drawing Sheets

FIG 1
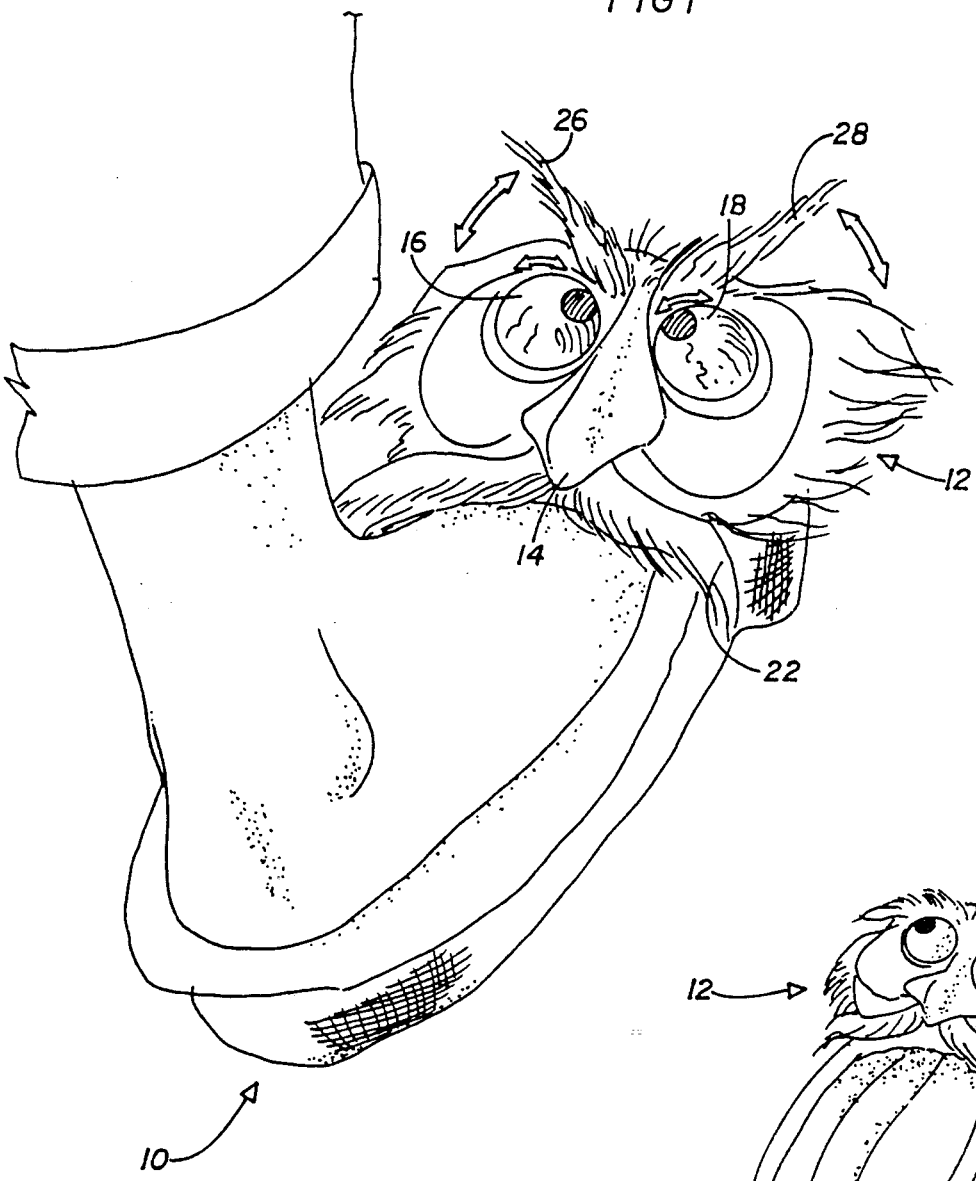
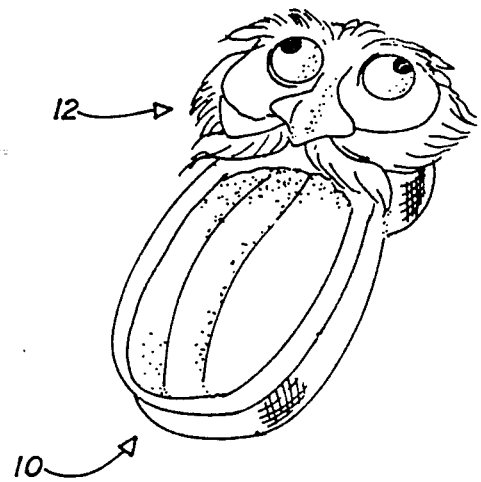
FIG 2

FOOTWEAR WITH ANIMATED FACE

BACKGROUND OF THE INVENTION

This invention relates to novel footwear, and more particularly to footwear fascinating to children, as well as being of considerable interest to adults of all ages, in that a simulated face is utilized on the upper front of the footwear, that changes its expression as the wearer takes steps.

As a generality, novelty footwear is well known to the art, and for example, the Maling Patent No. 2,421,796 entitled "Open-Toe Shoe" is provided with a device on the upper front portion in which a bottle of nail polish may be carried.

Another type of novelty shoe is taught by the Rocco Patent No. 3,070,907 entitled "Illuminating Dancing Shoe." This shoe has a novel illuminating means on the upper toe portion, which is controlled by a switch located in the sole portion of the shoe. The arrangement is such that upon the wearer stepping on this part of the shoe, the closing of the switch causes the light to come on.

Still another prior art device of pertinence is the Matsuda Patent No. 3,738,024 entitled "Footwear Having an Active Ornament." A sealed hollow space in the sole portion of the footwear is connected by a conduit to an ornament on the upper toe portion of the footwear, and upon the wearer taking a step, the air contained in the sole portion is pushed by the weight of the wearer through the conduit and causes the ornament to flutter. Optionally used is a whistle that will cause a sound to be produced each time the wearer takes a step.

As will be seen at greater length hereinafter, it is the purpose of the present invention to provide a novel shoe bringing considerable joy and amusement to the wearer, particularly the young wearer as well as to certain sports enthusiasts, which shoe has only a superficial similarity to the aforementioned patented devices.

SUMMARY OF THE INVENTION

In accordance with this invention, novel footwear for the human wearer comprises an inner sole, an outer sole, and an upper shoe surface affixed together in a wearable relationship, with an animated face utilized on the upper front or toe portion of the footwear, which face changes expression with every step the wearer takes. In the preferred embodiment, the footwear registers pain with each step taken.

A fixed arch member is located in a forward interior portion of the footwear, with its upper portion in contact with the interior portion of the upper shoe surface, and with its opposite lower edges being affixed to edge portions of the outer sole. The inner sole is interrupted at a forward location, and a spring biased treadle member of generally rectangular configuration is operatively disposed at such interrupted location. The lower edges of the fixed arch member are disposed at a location approximately corresponding to the location of the treadle member, with the forward part of the foot of the user, on occasion, entering such arch member and extending therethrough, with the metatarsal heads of the foot resting on the treadle. This portion of the foot is also known as the "ball" of the foot.

The upper central portion of the arch member serves as a support for simulated eye members, which are displayed on the exterior of the upper shoe surface. The eye members are pivotally mounted in spaced apart locations on the arch member, and have normal as well as inwardly deflected positions.

Linkage means are utilized which interconnect the eye members and the treadle, and as a result of such arrangement, the eye members are rotated for a limited number of degrees, preferably in an inward direction, each time the metatarsal heads of the wearer's foot press down upon the treadle member, or in other words, with each weight bearing step the wearer takes. When weight of the foot is removed from the treadle, spring bias means serve to rotate the eyes back to their first or normal positions. This spring bias means can be the spring bias associated with the treadle.

The change of facial expression can take place with regard only to the eyes of the face used on the forward part of the footwear, but in accordance with a principal embodiment of this invention, I may also arrange to have the eyebrows lift at the same time as the simulated eyes of the face move into the crossed positions.

The principal details of the novel footwear in accordance with this invention are the same for the left foot as well as for the right foot, so it is obviously necessary to describe only one item of footwear at this time.

One particularly important use of my invention is in connection with "apres ski boots." With the advent of the new high speed quad chairs at ski resorts, a skier is spending more time on the slopes than was the case when he or she spent a considerable amount of time in the long lines that were associated with the old chair lifts. Because the skier is now able to spend more time on the slopes, he or she can be expected to get tired sooner, and to find the ski lodge to be a comfortable haven.

Even moving about the ski lodge after hard hours of skiing can be tiring, particularly when it is considered that most ski lodges have a number of staircases to be traversed, and because ski boots are usually quite heavy, it is a great temptation for the skier to remove his boots and go about in his stocking feet. Unfortunately, the floor of the ski lodge usually has numerous puddles from melted snow as well as dirt and mud, meaning that the socks will soon become wet and soiled.

My apres ski boot is ideal for the skier to put on after he removes his ski boots, for they are light, durable, warm and furry, and with the animated face utilized on the upper shoe surface, these boots become highly entertaining to the wearer in addition to entertaining bystanders as well.

As should now be apparent, it is a principal object of this invention to provide novel footwear upon the upper front of which a simulated face is present, with such face being caused to modify its expression with each weight bearing step the wearer takes.

It is another object of this invention to provide novel footwear of inexpensive, comfortable and straightforward construction that features a simulated face whose changes of facial expressions with the wearer's steps provides considerable amusement and enjoyment to all.

It is yet another object of this invention to provide a simulated face on the upper front portion of each shoe of a pair of shoes, with each such face being represented by movable eyes over which are movable eyebrows, with each eyebrow lifting in concert with the respective eye being moved away from its normal position.

It is still another object of this invention to provide novel footwear of affordable and easily maintained construction that will provide the wearer with a constant source of amusement and comfort as he or she takes steps while wearing the footwear.

These and other objects, features and advantages will become more apparent as the description proceeds.

BRIEF DESCRIPTION OF THE DRAWINGS

FIG. 1 is a perspective view of a preferred embodiment of my invention, in which novel footwear having an animated face is depicted, with this face utilized on the upper front or toe portion of the shoe being able to change to a pained expression as weight is placed on a particular insole portion of the footwear;

FIG. 2 is a view to a smaller scale of the novel shoe depicted in FIG. 1, with the animated face in this instance having changed back to a normal expression;

DETAILED DESCRIPTION

Figure 5:
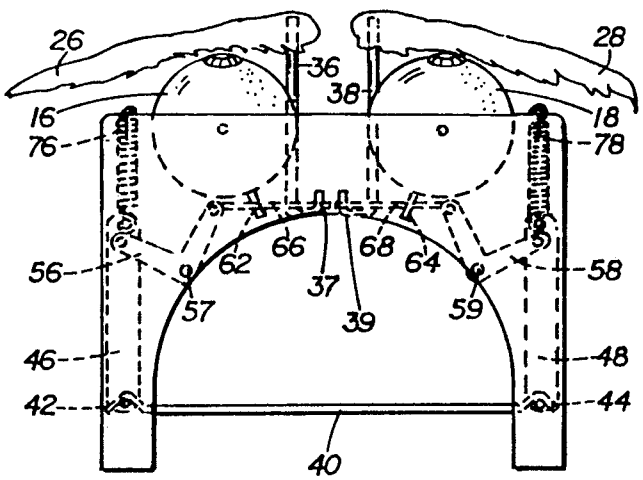
FIG. 5 is a view from the rear end of the footwear looking forward, with portions removed in order that internal construction can be revealed, including the treadle, which is here shown in its non-deflected position.

With initial reference to FIG. 1, it will there be seen that I have shown an item of footwear, which in this instance is footwear in the form of a shoe 10 having a relatively thick sole. As is obvious, the foot of a wearer or user has been inserted into the shoe depicted in FIG. 1, whereas in FIG. 2, the shoe is shown to a smaller scale with the foot removed.

It is important to note that on the upper front or toe portion of the shoe, a simulated face 12 appears, made up of a nose 14, a pair of eyes 16 and 18, a mustache 22, and a pair of eyebrows 26 and 28. It is also important to note that the face changes from one expression to the other with each step, as may be seen by comparing the appearance of FIG. 1 with FIG. 2. As is obvious, in FIG. 1 the eyes are crossed and the eyebrows are raised, as if to connote pain or discomfort, whereas in FIG. 2, the eyes and the eyebrows have automatically returned to their normal positions.

Figure 3:
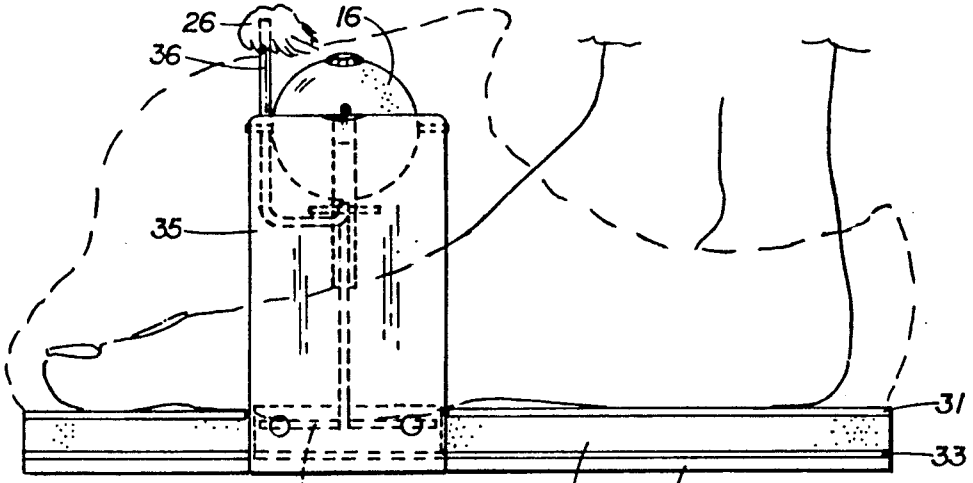
FIG. 3 is a side elevational view of my novel footwear, with the upper portions of the footwear having been removed in order to reveal internal construction, including a spring biased treadle to be contacted by the metatarsal heads of the wearer's foot.

In order that the expression on the face of my novel footwear will reliably change, I utilize an internal mechanism of the type shown in FIG. 3 and certain other figures. It will be noted that in FIG. 3 the insole 30 of the shoe is shown in cross section, with the wearer's foot resting thereon. A forward portion of the wearer's foot rests on a treadle member or pressure plate 40 responsible for bringing about changes of facial expression.

Figure 4:
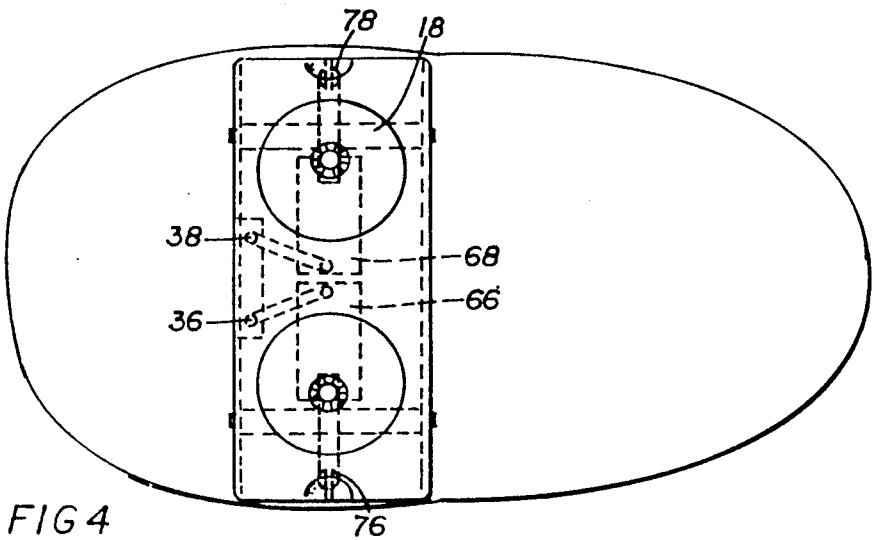
FIG. 4 is a plan view relatable to FIG. 3, with upper portions of the footwear being removed so as to reveal internal construction.
Figure 7:
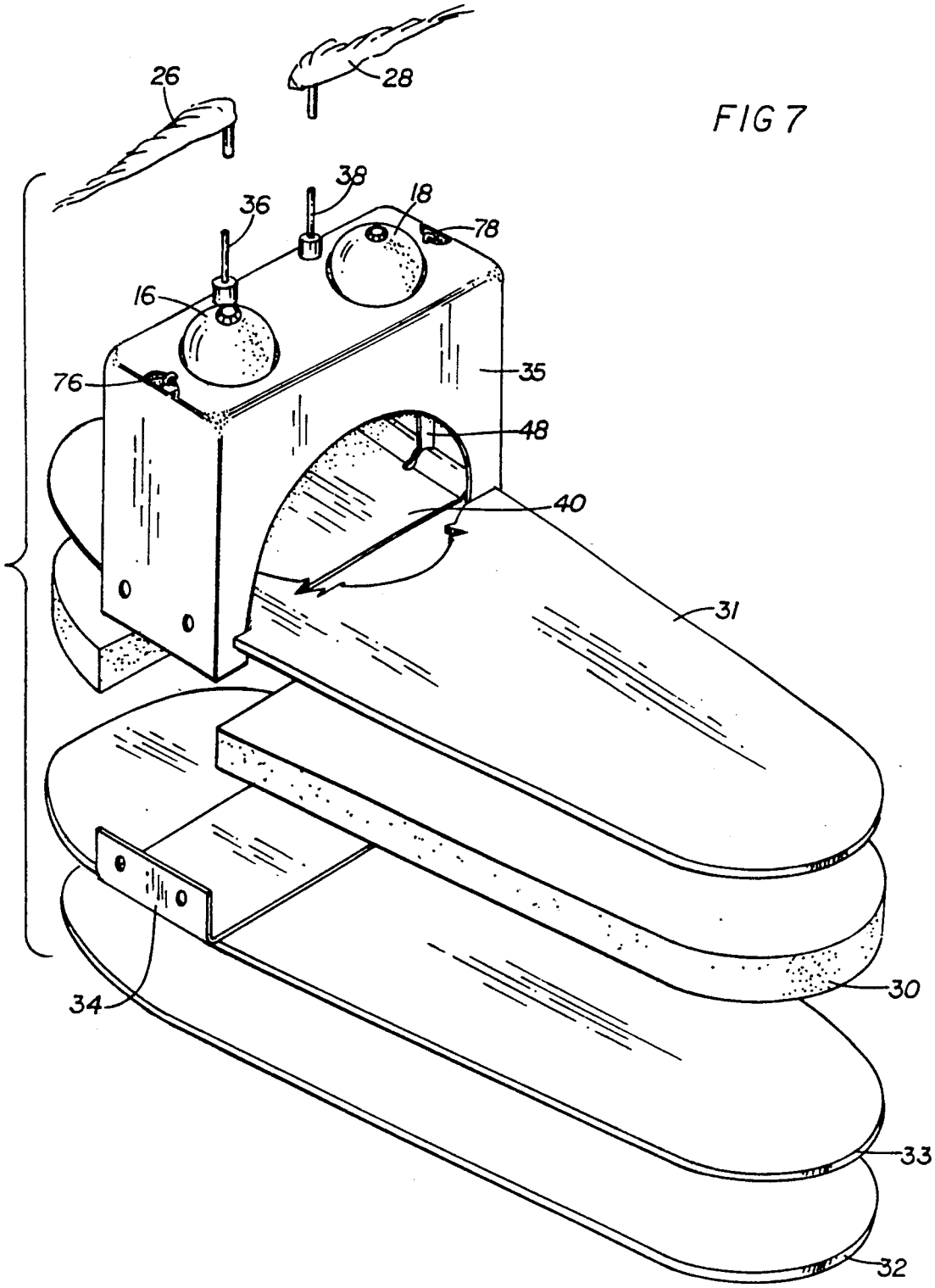
FIG. 7 is a perspective type view of my novel footwear, with certain portions shown in exploded relation in the interests of clarity.

In accordance with my invention, I utilize an arch-like member 35 located relatively near the toe portion of the shoe, as best seen in FIGS. 3 and 7, with this member 35 serving as a support for the eyes 16 and 18. Only eye 16 is visible in FIG. 3, whereas in FIGS. 4, 5, and 7, both eyes are visible. Strong, durable plastic is preferably used in the construction of the arch 35, not only because of its lightness and its inexpensiveness, but also because of the desirable visual effect.

In the construction of my novel shoe, I typically utilize a traction or outer sole 32 of durable, flexible rubber, which is designed to prevent the wearer from slipping, even on a sidewalk or stair that is wet with rain or snow. Directly above that I utilize a foundation sole 33 of durable, flexible plastic.

With reference to FIG. 7, it will be seen that affixed to the foundation sole 33 are a pair of fins 34, disposed on opposite edges of the sole. In other words, one fin is located on the outer edge and the other on the inner edge of the sole, with these fins being utilized as the support means for the arch-like member 35 that supports the movable eyes. It is to be noted that the fins 34 are positioned quite closely to the location of the metatarsal arch of the user's foot. These fins extend upward in such a manner that the outer edges of the arch member 35 can fit therebetween. I prefer to either rivet or to glue the bottom edges of the arch member 35 to the fins 34. For obvious reasons, I preferably create the traction sole and foundation sole to have sufficient flexibility as to be able to conform to the foot movements of the wearer.

It is desirable to provide a comparatively thick inner sole member on either side of the treadle member, and to that end I provide the insole 30 preferably of foam rubber, designed for the comfort of the wearer; note FIG. 7. The treadle or pressure plate 40 is positioned so as to be contacted by the ball of the foot, and typically the travel or excursion of the treadle is for a distance corresponding to the thickness of the foam rubber insole 30. The treadle member 40 is of relatively thin but rigid material, such as of aluminum or strong plastic.

Above the foam rubber insole 30 I may utilize an inner sole 31 of plastic or leather designed to give the interior of the shoe a finished appearance, and to prevent the moisture given off by the feet from time to time being absorbed by the foam rubber insole 30.

With regard to the eyes 16 and 18, they are generally spherical, of light weight, and are pivotally mounted. I have found that ping pong balls are ideal for use as eyes in many instances, with it being necessary to provide mounting means for the balls 16 and 18, so that they can rotate for a limited number of degrees. I find it desirable to paint eyes on these balls, to give them a realistic appearance. As will be noted in FIG. 5, the eyes normally look straight ahead when the treadle 40 is not being deflected.

Normal foot pressure is used in accordance with this invention to control the movement of the balls or eyes 16 and 18 such that the eyes will take on a crossed appearance as shown in FIG. 1 whenever the wearer puts weight on the "ball" of his foot, so to that end, I install the pressure plate or treadle member 40 at a location directly below the arch-like member 35, this member 40 being generally located between the bottom edges of the arch member 35. The treadle 40 is arranged to move within a guide or channel made of plastic, thus enabling free up and down movements of the treadle, with no binding or scraping.

As is obvious, the insole 30 is broken or interrupted at the location of the treadle, so that the treadle member 40 can readily be moved up and down by foot pressure provided by the wearer. Downward movements of the treadle may be against the bias provided by tension springs, as described hereinafter, with downward movements of the treadle resulting from the wearer placing weight on the forward portion of his foot, anatomically known as the metatarsal heads. The right and left edges of the treadle 40 have sufficient clearance that they can move without interference from the bottom portions of the arch member 35, or from the portions of the insole 30 located on each side of the treadle.

Figure 6:
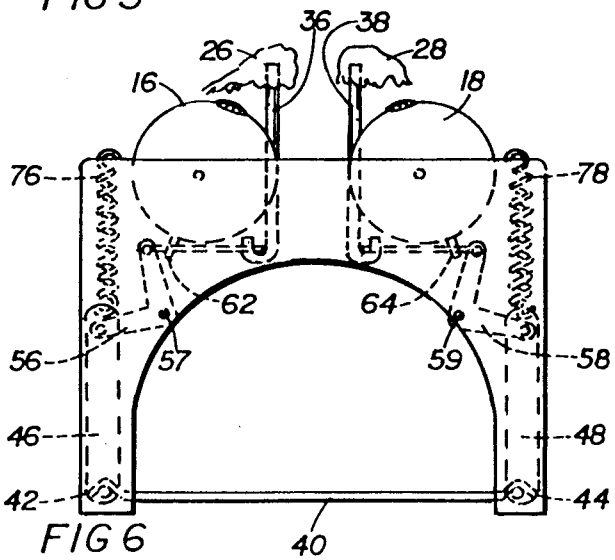
FIG. 6 is a view similar to FIG. 5 but with the treadle shown in the downwardly deflected position.

The treadle member 40 is normally biased upwardly by a spring force, of the type indicated for example in FIG. 3, and to a greater extent in FIGS. 5 and 6, where tension springs 76 and 78 are visible. In FIG. 5, the ends 42 and 44 of the treadle 40 are shown supported from vertically-disposed members 46 and 48, with the members 46 and 48 also being visible in FIG. 6. In FIG. 7 part of member 48 is visible.

FIG. 5 reveals a right-angled member 56 that is pivotally mounted at its midpoint 57 upon the left hand side of the arch-like support member 35, with the member 56 being readily movable between first and second positions, or as stated differently, between normal and deflected positions. In a like manner, right-angled member 58 is pivotally mounted at its midpoint 59 upon the right hand side of support member 35, so that it also can move in rotation as a result of up and down treadle movements. FIG. 5 also reveals that the members 56 and 58 are each connected to a respective link, with member 56 being connected to horizontal link 66, and member 58 being connected to horizontal link 68.

It is to be understood that upon the treadle 40 being pushed downwardly against the bias of springs 76 and 78 by the user's foot, from the upper or normal position shown in FIG. 5, into the lower or deflected position shown in FIG. 6, the vertical member 46 moves downwardly, causing the right-angled member 56 on the left side of the arch to rotate, and to cause movement of the horizontal link 66 from the position shown in FIG. 5, to the position shown in FIG. 6. Presuming the treadle to move downwardly while maintaining a substantially level attitude, the vertical member 48 is also caused to move downwardly, causing the right-angled member 58 and its horizontal link 68 to also move from their respective positions shown in FIG. 5 to the positions revealed in FIG. 6.

It is also to be understood that I may optionally use one or more compression springs under the treadle member 40, to provide a substantial part of the upward bias.

Returning to a consideration of FIG. 5, it is to be seen that the horizontal link 66 is contacted by a pin 62 disposed on the underside of the eye 16, and the horizontal link 68 is contacted by a pin 64 disposed on the underside of the eye 18, with this arrangement being responsible for supplying the desired back and forth motion to the eyes 16 and 18 at the time the links 66 and 68 move as a result of foot pressure being applied to the upwardly biased treadle 40. I prefer for the arrangement to be such that the eyes move inwardly together as the treadle is pushed down, and the eyes thereafter move apart as downward pressure on the treadle is removed.

It is to be understood that the wearer of my novel shoes can elect to control his foot movements such that one side of the treadle moves down to a further extent than the other side. This of course means that one eye will move to a different extent than the other eye. This is not typical, however.

It is also to be noted that the inner end of the horizontal link 66 connects to a laterally disposed hook portion 37 provided on the bottom end of the vertically disposed, rotatably mounted eyebrow supporting pin 36, whereas the horizontal link 68 connects to a hook portion 39 provided on the bottom end of the vertically disposed, rotatably mounted eyebrow supporting pin 38. Thus, at the same time as the horizontally disposed links 66 and 68 supply motion to the eyes 16 and 18, these links also supply rotation to the vertically disposed eyebrow supporting pins 36 and 38. This brings about the desired motion of the eyebrows 26 and 28 disposed on the left and right sides of the face 12.

In concert with the rotation of eye 16 away from its normal position, I preferably have the eyebrow 26 lift, and in concert with the rotation of eye 18 away from its normal position, I preferably have the eyebrow 28 lift, with the lifted positions of the eyebrows being revealed in FIG. 1. The eyebrows return to their generally level, normal positions as the eyes return to their first or normal positions.

Although the eyes typically cross and uncross in unison, this is not a firm requirement, for depending on the wearer's weight and foot characteristics, one eye may commence its crossing before the other, and/or complete its uncrossing before the other. The fact that the two sides of the treadle may be regarded as independently suspended, it is entirely possible for a wearer to deliberately control his foot movements in an effort to see how long he can delay the movement of the second eye, after movement of the first eye has commenced.

I am not limited to the eyes crossing and uncrossing, for it is within the scope of my invention to arrange the eyes to roll upwardly as the treadle is pushed downwardly, and then move back to the normal eye position as the treadle moves back to its undeflected position.

As is obvious, I am not to be limited to any particular linkages or other relationships, except as required by the scope of the appended claims.

Although I have depicted my novel footwear in connection with animated human faces, I am not to be limited to such, and it is within the scope of my invention also to be able to use animal faces, snakes, sharks, birds or the like on the upper forward portion of the footwear.

I claim:

1. Footwear having an upper front portion upon which an animated face with movable eyes is mounted, said footwear comprising an upper shoe surface, a sole, and a support member located in a forward interior portion of the footwear, in contact with the interior of said upper shoe surface, and with the lower portion of said support member affixed to said sole, a treadle member operatively disposed in the interior portion of said footwear, at a location generally corresponding to the location of said support member, with a forward part of the foot of the user normally resting on said treadle member, said treadle member being arranged to move downwardly upon weight being placed thereon, an upper portion of said support member serving as means for supporting simulated eye members, displayed on the exterior of said upper shoe surface, said eye members being pivotally mounted in spaced apart locations on said support member, and movable between first and second positions, and means mechanically interconnecting said eye members and said treadle member, said eye members being rotated from first to second positions each time the foot of the user presses down upon said treadle member, and bias means serving to rotate said eyes back to said first positions when the user's weight is removed from said treadle member.

2. Footwear as recited in claim 1 in which said support member is arch shaped.

3. Footwear as recited in claim 1 in which said eyes rotate inwardly for a limited number of degrees each time said treadle member is pushed down.

4. Footwear as recited in claim 1 in which said eyes rotate upwardly for a limited number of degrees each time said treadle is pushed down.

5. Footwear as recited in claim 1 in which said bias means is a pair of tension springs.

6. Footwear as recited in claim 1 in which said bias means involves at least one compression spring.

7. Footwear as recited in claim 1 in which a pair of movable eyebrows are mounted upon said face, which eyebrows move in conjunction with eye movements.

8. Footwear as recited in claim 7 in which each eyebrow moves in concert with the respective eye.

9. Footwear having an upper front portion upon which an animated face with movable eyes is mounted, said footwear comprising a sole and an upper shoe surface affixed together in a wearable relationship, an arch member located in a forward interior portion of the footwear, with its upper portion in contact with the interior of said upper shoe surface, and with its opposite lower edges being affixed to edge portions of said sole, a treadle member operatively disposed at a location generally corresponding to the location of said arch member, with the forward part of the foot of the user, on occasion, entering such arch member and extending therethrough, with the ball of the foot normally resting on said treadle member, said treadle member being arranged to move downwardly upon weight being placed thereon, the upper central portion of said arch member serving as means for supporting simulated eye members displayed on the exterior of said upper shoe surface, said eye members being pivotally mounted in spaced apart locations on said arch member, and movable between normal as well as deflected positions, and linkage means interconnecting said eye members and said treadle member, said eye members being rotated each time the foot of the user presses down upon said treadle member, and bias means serving to rotate said eyes back to their normal positions when the user's weight is removed from said treadle member.

10. Footwear as recited in claim 9 in which said eyes rotate inwardly for a limited number of degrees each time said treadle member is pushed down.

11. Footwear as recited in claim 9 in which said eyes rotate upwardly for a limited number of degrees each time said treadle is pushed down.

12. Footwear as recited in claim 9 in which said bias means is a pair of tension springs.

13. Footwear as recited in claim 9 in which said bias means involves at least one compression spring.

14. Footwear as recited in claim 9 in which a pair of movable eyebrows are mounted upon said face, which eyebrows move in conjunction with eye movements.

15. Footwear as recited in claim 14 in which each eyebrow moves in concert with the respective eye.

16. Footwear for the human wearer, upon the upper front portion of which an animated face with movable eyes is located, said footwear comprising an inner sole, an outer sole, and an upper shoe surface affixed together in a wearable relationship, a fixed arch member located in a forward interior portion of the footwear, with the upper portion of said arch member in contact with said upper shoe surface, and with the opposite lower edges of said arch member being affixed to edge portions of said outer sole, said inner sole being interrupted at a forward location, a treadle member of generally rectangular configuration operatively disposed at such interrupted location, means biasing said treadle member upwardly, said treadle member being disposed at a location generally corresponding to the location of said fixed arch member, with the forward part of the foot of the user, on occasion, entering such arch member and extending therethrough, with the ball of the foot normally resting on said treadle member, the upper central portion of said arch member serving as means for supporting simulated eye members, displayed on the exterior of said upper shoe surface, said eye members being pivotally mounted in spaced apart locations on said arch member, and having normal as well as deflected positions, and linkage means interconnecting said eye members and said treadle member, said eye members being rotated each time the foot of the user presses down on said treadle member, with said bias means serving to rotate said eyes back to their normal positions when the user's weight is removed from said treadle member.

17. Footwear as recited in claim 16 in which said eyes rotate inwardly for a limited number of degrees each time said treadle is pushed down.

18. Footwear as recited in claim 16 in which said eyes rotate upwardly for a limited number of degrees each time said treadle is pushed down.

19. Footwear as recited in claim 16 in which said bias means is a pair of tension springs.

20. Footwear as recited in claim 16 in which said bias means involves at least one compression spring.

21. Footwear as recited in claim 16 in which a pair of movable eyebrows are mounted upon said face, which eyebrows move in conjunction with eye movements.

22. Footwear as recited in claim 21 in which each eyebrow moves in concert with the respective eye.

23. Footwear as recited in claim 1 in which said eye members are separately connected to said treadle member so as to move independently of each other.

24. Footwear as recited in claim 9 in which said eye members are separately connected to said treadle member so as to move independently of each other.

25. Footwear as recited in claim 16 in which said eye members are separately connected to said treadle member so as to move independently of each other.

* * * * *